US006727473B2

(12) United States Patent
Taniguchi et al.

(10) Patent No.: US 6,727,473 B2
(45) Date of Patent: Apr. 27, 2004

(54) CERAMIC HEATER DEVICE AND METHOD FOR MANUFACTURING THE DEVICE

(75) Inventors: Masato Taniguchi, Aichi (JP); Haruhiko Sato, Aichi (JP); Katsuhisa Yabuta, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 2 days.

(21) Appl. No.: 10/133,440

(22) Filed: Apr. 29, 2002

(65) Prior Publication Data

US 2002/0153365 A1 Oct. 24, 2002

Related U.S. Application Data

(63) Continuation-in-part of application No. 10/092,593, filed on Mar. 8, 2002, now abandoned.

(30) Foreign Application Priority Data

Mar. 9, 2001 (JP) ..... 2001-66049

(51) Int. Cl.[7] ..... F23Q 7/00
(52) U.S. Cl. ..... 219/270; 219/544; 123/145 A
(58) Field of Search ..... 219/270, 544, 219/536; 123/145 A, 145 R; 361/264–266

(56) References Cited

U.S. PATENT DOCUMENTS 4,346,679 A * 8/1982 Knowles ..... 123/145 A
4,466,391 A * 8/1984 Page ..... 123/145 A
5,880,432 A * 3/1999 Radmacher ..... 219/270
6,084,212 A * 7/2000 Leigh ..... 219/270
2002/0130121 A1 * 9/2002 Taniguchi et al. ..... 219/270

FOREIGN PATENT DOCUMENTS

JP 61-225517 * 10/1986
JP 62-17522 * 1/1987
JP 4-332313 * 11/1992
JP 2001-141238 5/2001

* cited by examiner

*Primary Examiner*—John A. Jeffery
(74) *Attorney, Agent, or Firm*—Sughrue Mion, PLLC

(57) ABSTRACT

A ceramic heater 2 is arranged in a metallic cylinder member 3 by forming a convergent taper portion 2*t* at the leading end 2*a* of the ceramic heater 2 and by positioning the leading end 3*a* of the metallic cylinder member 3 on the leading end side of a taper starting point P1 of the taper portion 2*t*. Solder is applied in the clearance between the inner circumference 3*d* of the metallic cylinder member 3 and the outer circumference 2*b* of the heater 2. An applied solder layer 10 is also formed on the leading end side of the taper starting point P1 of the taper portion 2*t*. The thick solder layer 10 present on the leading end side prevents a cut or broken off portion of the ceramic heater from separating or sliding out.

1 Claim, 10 Drawing Sheets

Fig. 2
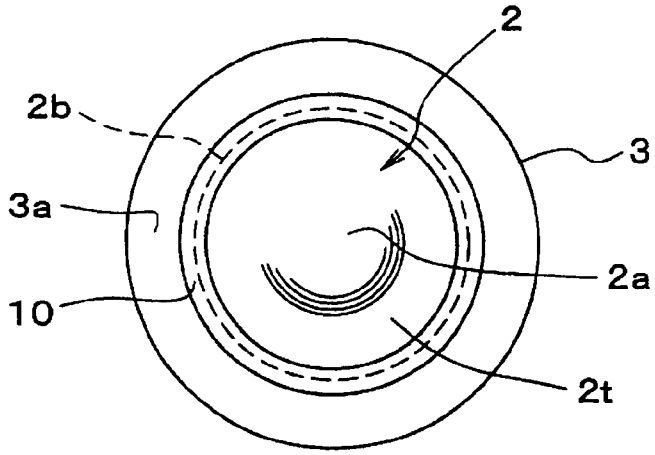
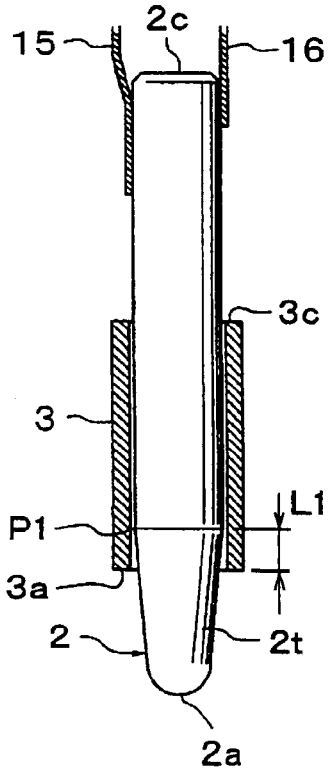
Fig. 3A
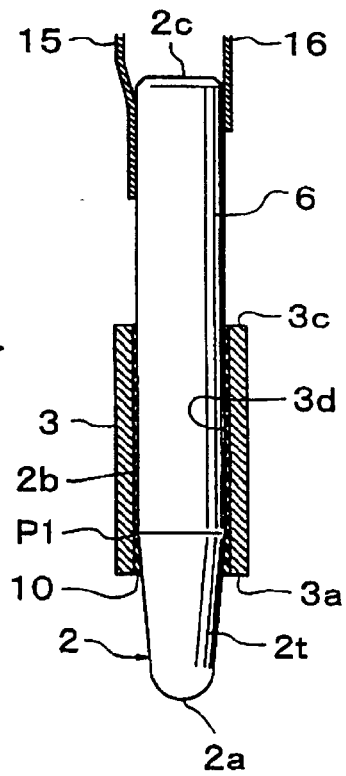
Fig. 3B

CERAMIC HEATER DEVICE AND METHOD FOR MANUFACTURING THE DEVICE

CROSS-REFERENCE TO RELATED APPLICATIONS

This application is a continuation-in-part of application Ser. No. 10/092,593 filed Mar. 8, 2002, now abandoned, the disclosure of which is incorporated herein by reference.

BACKGROUND OF THE INVENTION

1. Field of the Invention

The present invention relates to a ceramic heater device and, more particularly, but not exclusively, to either a glow plug to be used for promoting the start of a diesel engine or a ceramic heater device to be used as a heater for igniting a petroleum fan heater.

2. Description of the Related Art

FIG. 10 of the accompanying drawings shows a ceramic glow plug 101 for a diesel engine as one example of the ceramic heater device of this kind. A rod (or column) shaped ceramic heater 2 is so fixed on the inner side (or in a column-shaped hole) of a metallic cylinder member 3 that the heater leading end 2*a* may protrude from the leading end 3*a* of the metallic cylinder member (hereinafter also called the "cylinder member") 3. These two members are so retained (or fixed) in a metallic body (hereinafter also called the "body") 4 having a cylindrical shape as to protrude from the leading end 4*a* of the body. For this assembly, for example, the ceramic heater 2 is fixed gas-tight in the cylinder member 3 by fitting the ceramic heater 2 loosely in the cylinder member 3, by pouring a (not-shown) molten solder into the clearance, and by fastening the ceramic heater 2 by using the thermal expansion or cooling shrinkage of the cylinder member 3 by the poured solder layer 10. The assembly is completed by likewise fitting the cylinder member 3 integrated with the ceramic heater 2 loosely in the body 4 and by pouring the molten solder 10 into the clearance.

Here, the ceramic heater 2 is prepared by burying a (not-shown) heating member made of conductive ceramics and of a ceramic heating element or a high-melting point metal wire folded back (into a shape of letter "U"), in its portion close to the heater leading end 2*a*. At the two end portions of the U-shape of the heating member (or at the end portions of the two legs), moreover, terminals are disposed on the side faces of the ceramic heater 2 close to the rear end 2*c* through relay wires, and power feeding leads 15 and 16 are soldered to those terminals. The heater device thus constructed is able to generate a resistive heat to heat the ceramic heater 2 by feeding an electric current thereto through the power feeding leads 15 and 16.

In the structure of the prior device thus far described, the ceramic heater 2 fixed in the cylinder member 3 with the solder layer is subject to various external forces (e.g., an impact due to a fall or a bending force when it is mounted on the engine) in the subsequent manufacturing process or handling until the glow plug 101 is assembled. Therefore, the ceramic heater 2 may be cut (or broken) in the metallic cylinder member 3 along a thick line portion S, as shown in FIG. 10. However, this cut occurs in the metallic cylinder member 3 so that it cannot be visually confirmed from the outside. As a result, the structure may be assembled as it is in an engine (i.e., in a cylinder or an auxiliary combustion chamber) E.

During the combustion of the engine, on the other hand, the ceramic heater 2 is always exposed to a large temperature change (or a thermal shock) and a blast. When the engine is run, therefore, the metallic cylinder member 3 and the ceramic heater 2 are caused to relax (or become loose) therebetween by the difference in thermal expansion due to the temperature rise and/or due to vibration. If the relaxation occurs in the metallic cylinder member 3 having an inner circumference 3*d* of a constant internal diameter and a straight shape, on the other hand, the ceramic heater 2 is divided at the cut portion on the side of the leading end 2*a*, as shown in FIG. 11, to raise a problem that the cut portion may be separated and drop into the combustion chamber of the engine E.

Specifically, the soldered portions of the metallic cylinder member 3 and the body 4 have high and stable joint strength because the two members are made of metals. Although the joint strength between the inner circumference 3*d* of the metallic cylinder member 3 and the solder layer 10 is high, on the other hand, the joint strength between the outer circumference 2*b* of the ceramic heater 2 and the solder layer 10 is relatively low because they have just shrunk. Moreover, the ceramics and the solder have highly different coefficients of thermal expansion. Therefore, a relaxation (or looseness) easily occurs in the interface between the outer circumference 2*b* of the ceramic heater 2 and the solder layer 10. Especially in the case that the metallic cylinder member 3 is cut near the leading end 3*a*, its force for holding the cut portion of the ceramic heater 2 is so weak as to invite the separation or slide-out of the cut portion.

In another ceramic heater device, the ceramic heater is not fixed with the solder layer but is held by press-fitting it in the metallic cylinder member 3. In the case in which the ceramic heater has the aforementioned cut even if press-fitted, however, a problem arises in that the cut portion separates or slides out, as in the ceramic heater device using the solder layer. Independently of the solder layer structure or the press-fit structure, moreover, the cut of the ceramic heater may occur after it has been assembled in the engine, and a similar problem arises.

SUMMARY OF THE INVENTION

The present invention has been achieved in view of the aforementioned problems in the ceramic heater device such as the glow plug of the prior art, and an object of the invention is to prevent the cut portion of the ceramic heater from separating and sliding out from the structure in which the ceramic heater is fixed in the metallic cylinder member by soldering or press-fitting it therein.

Accordingly, the invention provides a ceramic heater device having a structure in which an axial ceramic heater is arranged in a metallic cylinder member so that its leading end protrudes from the leading end of said metallic cylinder member, wherein:

- a convergent taper portion is formed at the leading end of said ceramic heater;
- the leading end of said metallic cylinder member is disposed on the leading end side of the taper starting point of said taper portion;
- said metallic cylinder member and said ceramic heater are fixed to each other with a solder layer interposed between their inner circumference and outer circumference respectively; and
- at least a portion of said solder layer is also disposed on the leading end side of the taper starting point of said taper portion By the aforementioned means, the solder layer is caused to exist on the leading end side from the taper starting point of the taper portion. This solder layer engages the taper portion to thereby prevent the ceramic heater from sliding out to the leading end side with respect to the metallic cylinder member even if the ceramic heater is relaxed in the metallic cylinder member. Even if the ceramic heater is cut on the rear end side of the taper starting point of the taper portion, for example, so that relaxation occurs in the interface between the outer circumference on the leading end side from the cut portion and the solder layer, more specifically, the solder layer existing on the leading end side from the taper starting point of the taper portion is thick on the surface of the taper portion. This thick portion engages the taper portion to thereby prevent the cut leading end portion of the ceramic heater from sliding out from the metallic cylinder member. Thus, in the case in which the present invention is embodied as the glow plug, the cut portion of the ceramic heater 2 is prevented from dropping into the auxiliary combustion chamber of the engine, even if relaxation occurs between the ceramic heater and the metallic cylinder member when the ceramic heater is assembled in the engine and run while having a cut in the metallic cylinder member. Preferably, the cone angle of the taper portion is properly set in the range of from about 10 minutes to 5 degrees.

According to a further aspect, the invention provides a ceramic heater device having a structure in which an axial ceramic heater is arranged in a metallic cylinder member so that its leading end protrudes from the leading end of said metallic cylinder member and in which said metallic cylinder member and said ceramic heater are fixed to each other with a solder layer interposed between their inner circumference and outer circumference respectively, wherein:

in said ceramic heater, a diametrically smaller portion having a smaller diameter than that of the remaining portion in said metallic cylinder member is formed at a portion located in said metallic cylinder member and corresponding to the portion proximate to the leading end of said metallic cylinder member; and a solder layer is disposed at said diametrically smaller portion for preventing at least a portion of said ceramic heater from sliding out toward the leading end with respect to said metallic cylinder member.

The diametrically smaller portion may be either a straight portion formed straight toward the leading end, or a taper portion having a convergent taper shape. Here, the diametrically smaller portion in the present invention includes a constriction or a circumferential groove formed on the axis. The solder layer enters into the diametrically smaller portion to prevent slide-out at the time when the ceramic heater is liable to slide out to the leading end side from the metallic cylinder member.

Here, in any of the aforementioned means, the solder layer for preventing slide-out is constructed by the difference between the maximum and minimum external diameters of the ceramic heater at the portion proximate to the leading end of the metallic cylinder member, and this difference may be within a range of 10 microns to 300 microns. The slide-out preventing action is insufficient, if the difference is smaller than 10 microns. If the difference exceeds 300 microns, on the other hand, the molten solder is unable to spread over (or to bridge) the clearance between the inner circumference of the metallic cylinder member and the outer circumference of the ceramic heater by a capillary phenomenon, to thereby cause a danger that fixation with the solder layer fails.

According to a further aspect, the invention provides a ceramic heater device having a structure in which an axial ceramic heater is arranged in a metallic cylinder member so that its leading end protrudes from the leading end of said metallic cylinder member and in which said metallic cylinder member and said ceramic heater are fixed to each other with a solder layer interposed between their inner circumference and outer circumference respectively, wherein:

at least one recess is formed in the outer circumference of said ceramic heater at a portion located in said metallic cylinder member and corresponding to the portion proximate to the leading end of said metallic cylinder member, wherein a solder layer is disposed in said at least one recess for preventing sliding out of at least a portion of said ceramic heater toward the leading end with respect to said metallic cylinder member.

According to a further aspect, the invention provides a ceramic heater device having a structure in which an axial ceramic heater is arranged in a metallic cylinder member so that its leading end protrudes from the leading end of said metallic cylinder member, wherein:

a convergent taper portion is formed at the leading end of said ceramic heater;

said ceramic heater is press-fitted in said metallic cylinder member so that the taper starting point of said taper portion is positioned at a portion proximate to the leading end of said metallic cylinder member; and the leading end of said metallic cylinder member converges at said taper portion.

With this construction, the rod-shaped ceramic heater can be arranged without being fixed with the solder layer so that the heater leading end may protrude from the leading end of said metallic cylinder member. In addition, the leading end of the metallic cylinder member converges at the taper portion so that it engages with the taper portion to perform the slide-out preventing action. Therefore, the leading end of the ceramic heater is prevented, even if cut, from sliding out from the metallic cylinder member, as described hereinbefore. With this structure, moreover, the ceramic heater device having the slide-out preventing action can be easily formed by press-fitting the ceramic heater with a suitable press-fit allowance into a predetermined depth of the metallic cylinder member.

According to a further aspect, the invention provides a method for manufacturing a ceramic heater device having a structure in which an axial ceramic heater is arranged in a metallic cylinder member so that its leading end protrudes from the leading end of said metallic cylinder member, comprising the steps of:

forming a convergent taper portion at the leading end of said ceramic heater; and press-fitting said ceramic heater into said metallic cylinder member, starting with the leading end of the ceramic heater, to such a position that the taper starting point of said taper portion does not go beyond the leading end of said metallic cylinder member.

BRIEF DESCRIPTION OF THE DRAWINGS

FIG. 2 is an enlarged view of the glow plug of FIG. 1 taken from the side of the leading end face;

FIG. 3 shows sectional views for explaining the steps of inserting the ceramic heater making the glow plug of FIG. 1 into a metallic cylinder member and soldering it: FIG. 3A presents a sectional view in the set state before soldering; and FIG. 3B presents a sectional view after being soldered;

FIG. 9 shows sectional views for explaining the steps of assembling the ceramic heater for making the glow plug of FIG. 8 by press-fitting it into a metallic cylinder member.

Figure 1A:
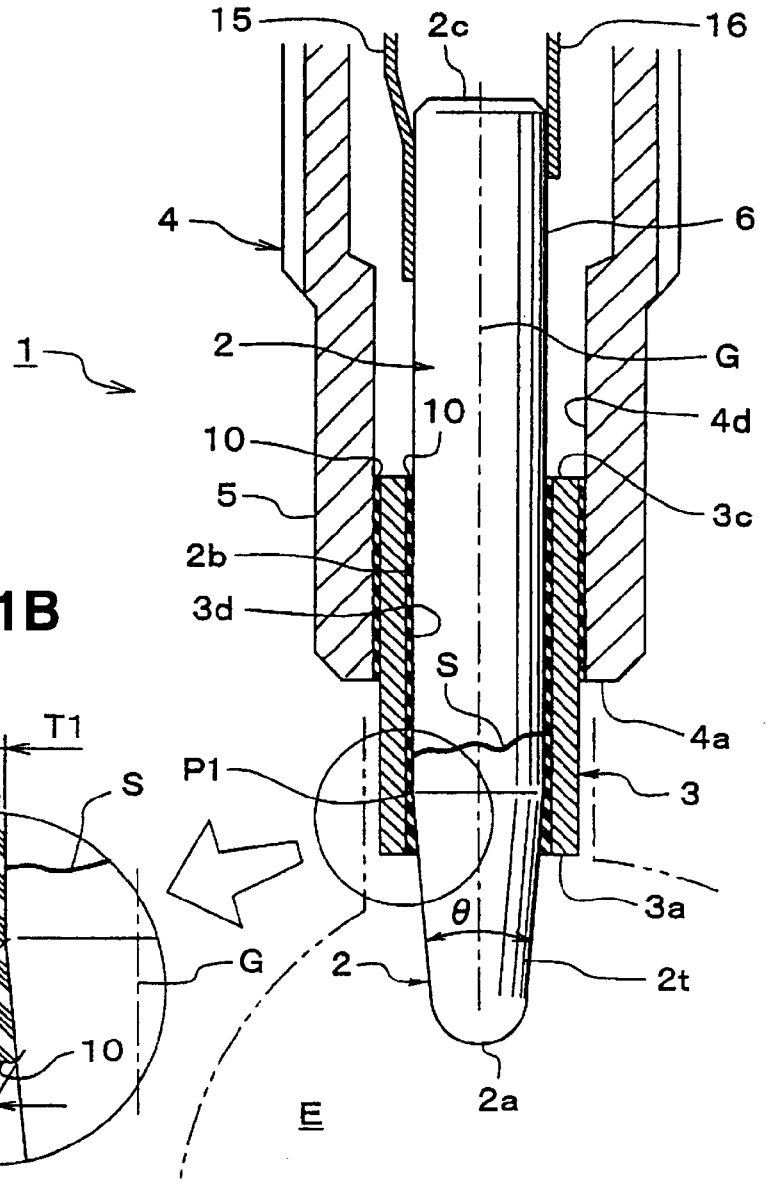
FIG. 1A is a sectional view of a specific portion of an embodiment of a ceramic heater device (or glow plug) according to the present invention.

Reference numerals are used to identify items shown in the drawings as follows:

1, 21, 31, 41, 61 . . . glow plug (ceramic heater device)

2, 22, 32, 42 . . . ceramic heater

2*a* . . . leading end of ceramic heater

2*b* . . . outer circumference of ceramic heater

2*t* . . . taper portion

2*s*, 22*s*, 32*s* . . . diametrically smaller portion (straight portion)

3 . . . metallic cylinder member

3*a* . . . leading end of metallic cylinder member

3*d* . . . inner circumference of metallic cylinder member

10 . . . solder layer (silver solder)

42*s* . . . recesses in outer circumference of ceramic heater

P1 . . . taper starting point of taper portion

D1 . . . external diameter of column portion of ceramic heater

D2 . . . external diameter of diametrically smaller portion of ceramic heater

DESCRIPTION OF THE PREFERRED EMBODIMENTS

The invention is now described in detail by reference to the drawings. However, the invention should not be construed as being limited thereto.

Figure 1B:
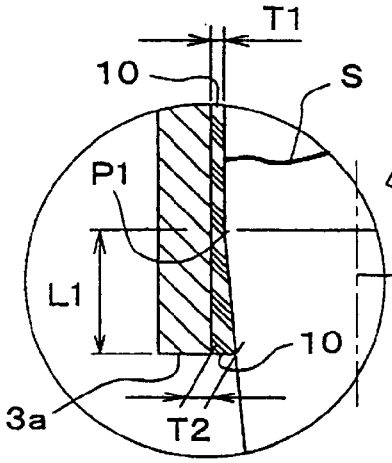
FIG. 1B is an enlarged sectional view of a specific portion.

A first embodiment of the present invention will be described in detail with reference to FIG. 1 to FIG. 4. FIG. 1 shows a section of a specific portion of a glow plug 1 for a diesel engine as the ceramic heater device. This glow plug 1 is constructed of: a ceramic heater 2 having a convergent round rod shape (or a circularly sectional shaft shape); a metallic cylinder member 3 arranging the ceramic heater 2 by fitting therein and by fixing it with a solder material layer; and a body 4 for holding the metallic cylinder member 3 having the heater 2 integrated therewith. The ceramic heater 2 protrudes at a portion closer to its leading end 2*a* (as located at the lower end of FIG. 1) and loosely fitted in the metallic cylinder member 3 and is fixed with a silver solder 10. Then, the metallic cylinder member 3 is assembled with the body such that it is loosely fitted at a portion close to its rear end 3*c* in a diametrically reduced portion 5, in which the inner circumference 4*d* close to the leading end 4*a* of the body 4 is slightly diametrically reduced, and is fixed with the silver solder 10. Here, reference numerals 15 and 16 in FIG. 1 designate power feeding leads which are connected with the terminals led out to the side face close to the rear end 2*c* of the ceramic heater 2. Moreover, the glow plug is constructed to generate heat at the heater leading end when fed with an electric current through the power feeding leads 15 and 16. This fundamental construction is identical to that of the glow plug of the prior art.

On the other hand, the ceramic heater 2 constituting the glow plug 1 of the present embodiment is constructed of: a column portion 6 having a straight circular section of an equal diameter; and a convergent taper portion 2*t* having a frusto-conical shape from the end portion (as located at the lower end portion of FIG. 1) of the column portion 6 and tapered to the leading end. In this embodiment, moreover, this ceramic heater 2 is constructed such that the column shape of a diameter of 3.5 mm and a length of 45 mm converges into the taper portion 2*t* within a range of 12 mm from the leading end to the rear end side of the column shape. However, the cone angle θ of the taper portion 2*t* is exemplified by 1 degree and 30 minutes, and the leading end 2*a* is formed into a hemispherical shape. Here, this ceramic heater 2 is formed by burying and sintering a resistive heating element (or wire) made of conductive ceramics or a high-melting point metal, although not shown, in a ceramic substrate made of a ceramic insulator such as silicon nitride.

Moreover, this ceramic heater 2 is inserted and loosely fitted in the cylinder member (having a length of 20 mm) 3 made of a metal (e.g., SUS430) and a straight cylindrical shape of a constant thickness, and is soldered with silver solder by positioning the leading end 3*a* of the metallic cylinder member 3 with a size L1 to the leading end from a taper starting point P1 of the taper portion 2*t*. Thus, the ceramic heater protrudes at a portion close to its leading end 2*a* by a predetermined length (i.e., 10 mm in the present embodiment). The solder layer 10 is also present on the outer circumference of the column portion 6 and on the outer circumference on the leading end side of the taper starting point P1 of the taper portion 2*t*, and is made thicker on the leading end side of the taper starting point P1. Here in the present embodiment, the cylinder member 3 has an internal diameter of 3.6 mm and a thickness of 0.7 mm.

Thus, in the present embodiment, the solder layer 10 has a substantially constant thickness T1 of 50 microns on the outer circumference of the straight column portion 6 on the rear end side from the taper starting point P1 of the taper portion 2*t* of the ceramic heater 2. On the circumference of the taper portion 2*t*, however, the thickness becomes larger to correspond to the convergent taper towards the leading end side, and has a maximum thickness at the leading end 3*a* of the metallic cylinder member 3. The maximum thickness T2 is about 80 microns in the present embodiment. As shown in FIG. 1 more specifically, since the taper portion 2*t* exhibits a conical shape, the solder layer 10 increases its thickness towards the leading end 3*a*, the movement of the ceramic heater 2 toward the leading end 3*a* is prevented.

Therefore, in the case that the ceramic heater 2 is cut along a line S in FIG. 1, for example, and mounted as it is in an auxiliary combustion chamber E of the diesel engine, and this engine is run, what will be caused is as follows. In the present embodiment, more specifically, even if the solder layer 10 and the outer circumference of the ceramic heater 2 are separated at their interface by a thermal shock or blast accompanying running of the engine so that the side of the leading end 2*a* of the ceramic heater 2 slides out to the leading end side with respect to the metallic cylinder member 3, its slide-out is prevented by the solder layer 10 of the wedge-shaped section present at the taper portion 2*t*. Even if the leading end portion of the ceramic heater 2 is thus cut to become loose with the solder layer 10, therefore, the leading end side of the cut portion does not drop into the auxiliary combustion chamber E unlike the prior art. Moreover, a similar effect can be expected even if that cut occurs after the ceramic heater is assembled in the engine. Thus in the present embodiment, the solder layer 10 fixed on the taper portion 2*t* prevents the ceramic heater from sliding out to the leading end side so that it can prevent the leading end portion of the ceramic heater 2 from separating or falling.

In the present embodiment, the slide-out preventing action increases as the cone angle θ of the taper portion 2*t* increases and as the solder layer 10 present at the taper portion 2*t* has a larger size in the direction of the axis G. At a larger cone angle θ and in the larger size solder layer 10 in the direction of the axis G, however, the clearance between the outer circumference 2*b* of the taper portion 2*t* of the ceramic heater 2 before soldering and the inner circumference 3*d* of the metallic cylinder member 3 becomes larger on the leading end side. Therefore, a danger arises in which the wetting spread of the molten solder due to a capillary phenomenon at the time of pouring the molten solder is blocked so that the solder fails to spread sufficiently to the leading end side from the taper starting point P1 of the taper portion 2*t*. At a smaller cone angle θ, on the other hand, the slide-out preventing action is reduced. The cone angle θ is preferably set within a range of 10 minutes to 5 degrees, depending upon the distance L1 from the taper starting point P1 of the taper portion 2*t* to the leading end face 3*a* of the metallic cylinder member 3. In the case that sufficient slide-out preventing action cannot be expected, the soldering work may be done after the portion close to the leading end 3*a* of the metallic cylinder member 3 is caulked by constricting or drawing.

With reference to FIG. 3, a method of soldering the ceramic heater 2 in the present embodiment to the metallic cylinder member 3 is described. Here, the support jigs of the two to be used in the soldering work are omitted from FIG. 3. As shown in sectional view FIG. 3A, the ceramic heater 2 is inserted and loosely fitted in the cylinder member 3 and is held with its leading end 2*a* protruding to a predetermined distance. Specifically, the leading end 3*a* of the metallic cylinder member 3 is positioned with the size L1 being on the leading end side from the taper starting point P1 of the taper portion 2*t*. In this state, the molten solder (of silver) is then poured into the clearance. Thus, the metallic cylinder member 3 and the ceramic heater 2 are fixed between their inner circumference 3*d* and the outer circumference 2*b* through the solder material therebetween, as shown in sectional view FIG. 3B, and the solder layer 10 is present not only on the outer circumference 2*b* of the column portion 6 but also on the leading end side from the taper starting point P1 of the taper portion 2*t*. Here, for improving the wettability of the molten solder it is preferable to apply molten glass to the circumference (or surface) of the ceramic heater 2 and to bake it.

Figures 4A, 4B:
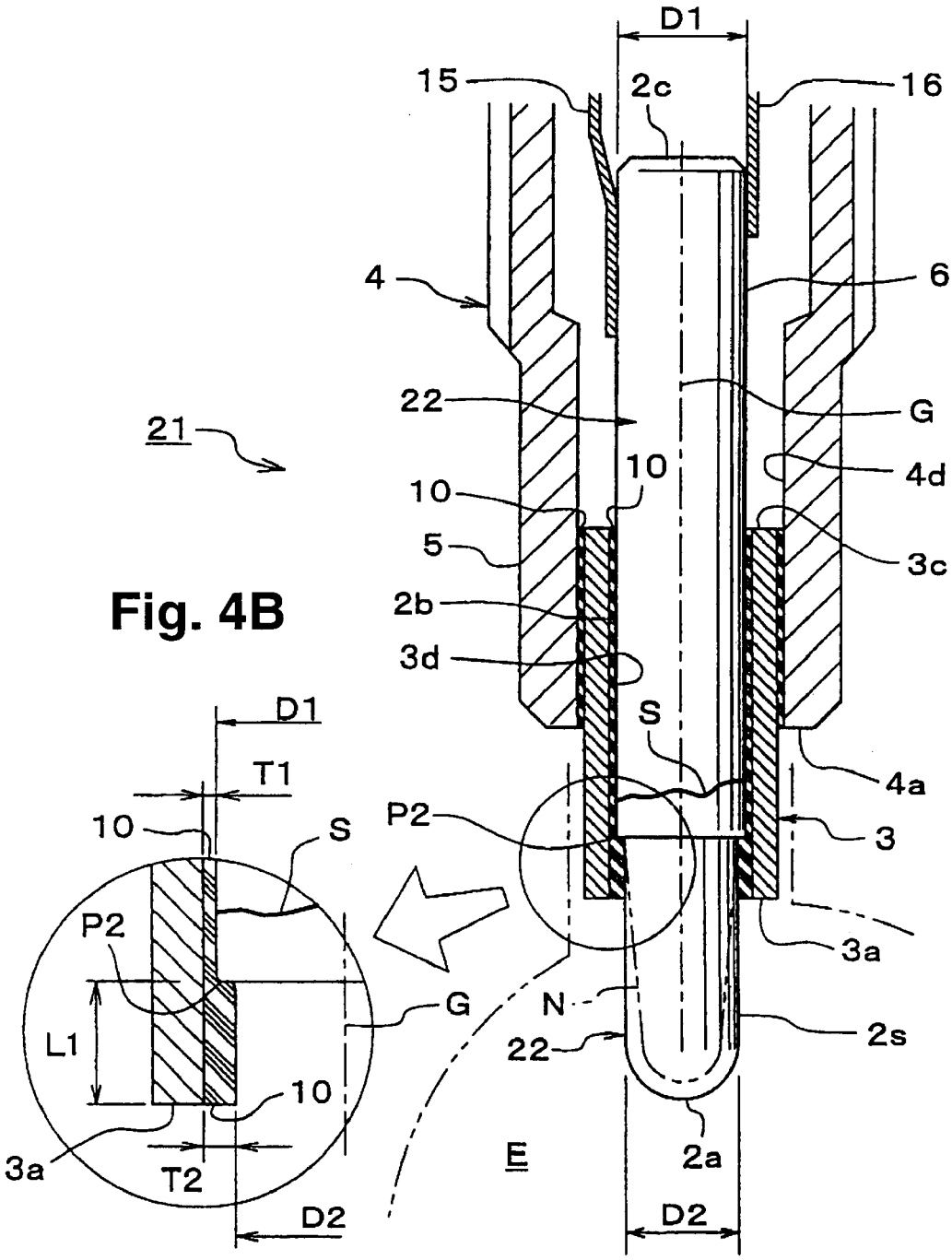
FIG. 4A is a sectional view of a specific portion of an embodiment of a ceramic heater device (or glow plug) according to the present invention.
FIG. 4B is an enlarged sectional view of a specific portion.

Next, a second embodiment of the present invention will be described in detail with reference to FIG. 4. However, a glow plug 21 of the present embodiment is a modification of the foregoing embodiment so that description will be made only on different points by designating identical portions by identical reference numerals.

In the foregoing embodiment, the leading end of the ceramic heater 2 is formed into a convergent taper shape. In the present embodiment, on the other hand, a diametrically smaller portion 2*s* having a smaller diameter D2 than that D1 of the remaining portion (i.e., the column portion) 6 is formed at that portion of the ceramic heater 2, which is located in the metallic cylinder member 3 and which corresponds to the portion close to the leading end 3*a* of the metallic cylinder member 3. Here, the diametrically smaller portion 2*s* has a circular section, which is coaxial (or concentric) with the remaining portion, i.e., the diametrically larger column portion 6 close to the rear end, and forms a straight portion toward the leading end 2*a*. Here in the present embodiment, the diametrically larger portion 6 has a diameter D1 of 3.5 mm whereas the diametrically smaller portion 2*s* has the diameter D2 of 3.3 mm, and the metallic cylinder member 3 is identical to the aforementioned one. Therefore, the solder layer 10 has a thickness T1 of about 50 microns on the outer circumference of the diametrically larger portion 6 and a thickness of about 150 microns on the outer circumference of the diametrically smaller portion 2*s*.

The present embodiment also exhibits actions and effects similar to those of the foregoing embodiment, even if the fixed solder layer 10 and the outer circumference of a ceramic heater 22 is relaxed at their interface when the ceramic heater is cut along the line S. Specifically, the solder layer 10 present on the outer circumference of the diametrically smaller portion 2*s* and within a range of a length L1 along the axis G prevents the cut portion of the ceramic heater 22 from sliding out to prevent the fall of the same.

In the present embodiment, a clearly different diameter step portion is formed at a boundary point P2 between the diametrically larger portion 6 and the diametrically smaller portion 2*s* so that the slide-out preventing action is superior to that of the foregoing embodiment. Here, the diametrically smaller portion 2*s* is not be limited to a straight shape but may be tapered into a convergent taper shape, as indicated by double-dotted line N in FIG. 4. The cone angle of this case is preferably fixed within a range of 10 minutes to 45 degrees. In any event, however, the diametrically smaller portion 2*s* is preferably coaxial (or concentric) with the diametrically larger portion. Moreover, the diametrically smaller portion 2*s* invites, if excessively thin, an insufficient charge of the solder material. Therefore, the thickness of the diametrically smaller portion 2*s* and the size L1 of the solder layer may be set within a range for providing the proper slide-out preventing action but without insufficient charge. In case this sufficient slide-out preventing action cannot be expected, too, the portion close to the leading end 3*a* of the metallic cylinder member 3 may be fixed by the solder layer after it is caulked by constricting or drawing.

Figure 5A:
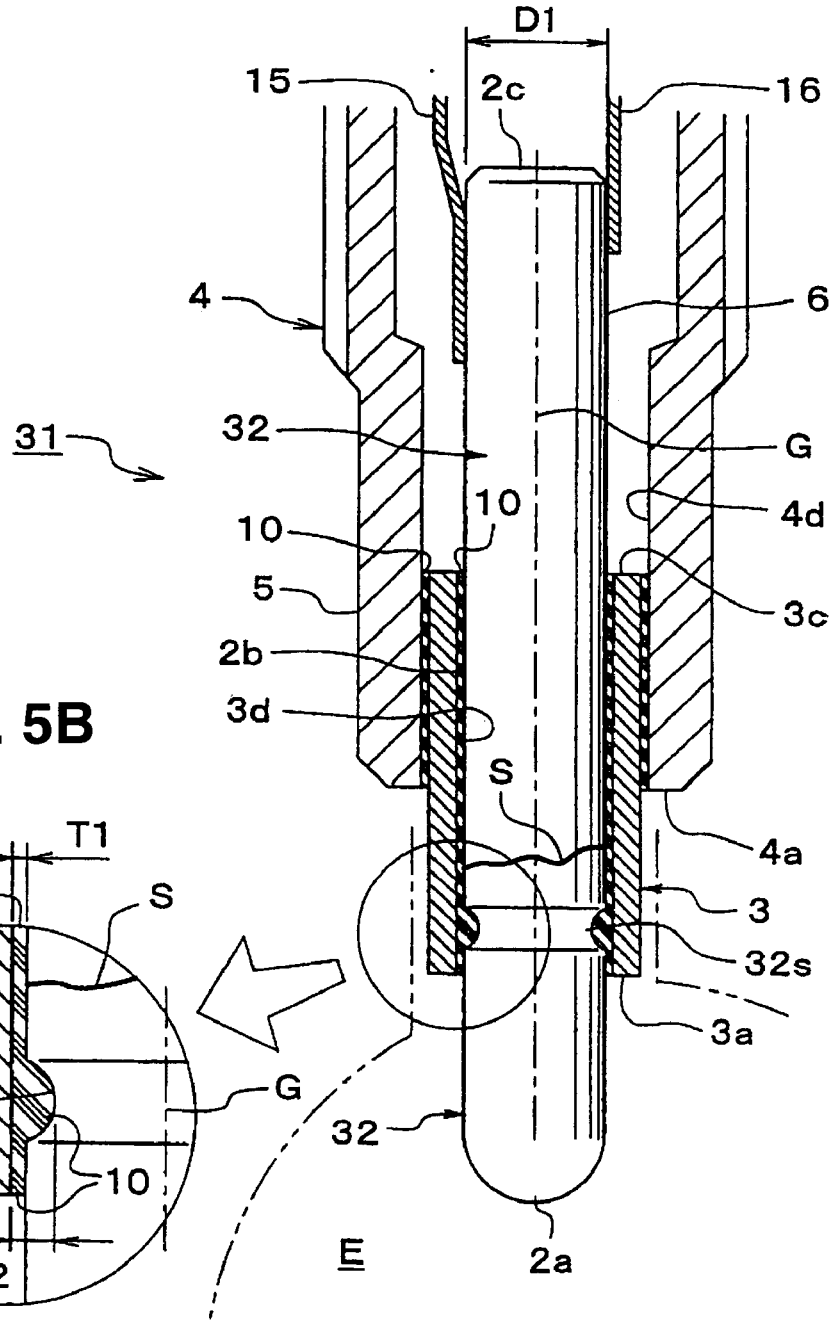
FIG. 5A is a sectional view of a specific portion of an embodiment of a ceramic heater device (or glow plug) according to the present invention.
Figure 5B:
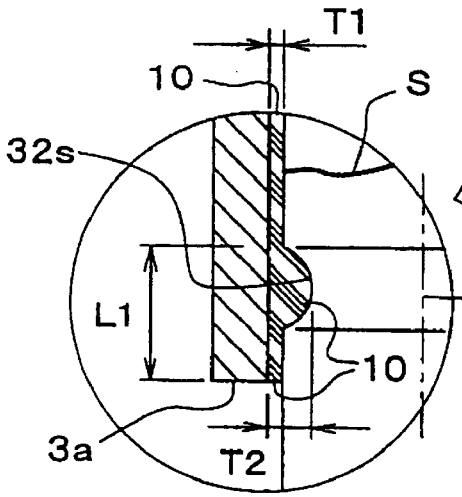
FIG. 5B is an enlarged sectional view of a specific portion.

Next, another embodiment of the present invention will be described with reference to FIG. 5. However, a glow plug 31 of the present embodiment is a modification of the foregoing embodiment so that description will be made only on different points by designating identical portions by identical reference numerals.

In the foregoing embodiment, more specifically, the diametrically smaller portion 2*s* having a diameter smaller than that of the remaining portion is formed at the portion of the ceramic heater 22 which is located in the metallic cylinder member and which corresponds to the portion close to the leading end 3*a* of the metallic cylinder member 3. The portion 2*s* is formed to have a circular section, which is coaxial (or concentric) with the remaining portion, i.e., the diametrically larger column portion 6 close to the rear end, and to have a straight portion toward the leading end. In the present embodiment, on the contrary, a diametrically smaller portion 32*s* is formed to have a circumferential groove or constriction towards the axis.

Of the solder layer 10 fixing the outer circumference of a ceramic heater 32 and the inner circumference of the metallic cylinder member 3 through the solder material, the solder present in that diametrically smaller portion (or the circumferential groove) 32*s* prevents slide-out of the ceramic heater 32 similar to the foregoing embodiment. The thickness of the diametrically smaller portion 32*s* (or the depth of the circumferential groove) and the width of the diametrically smaller portion (or the circumferential groove) may be set to sizes necessary for the solder layer which has flowed thereinto to provide the slide-off preventing action.

Figures 6A, 6B:
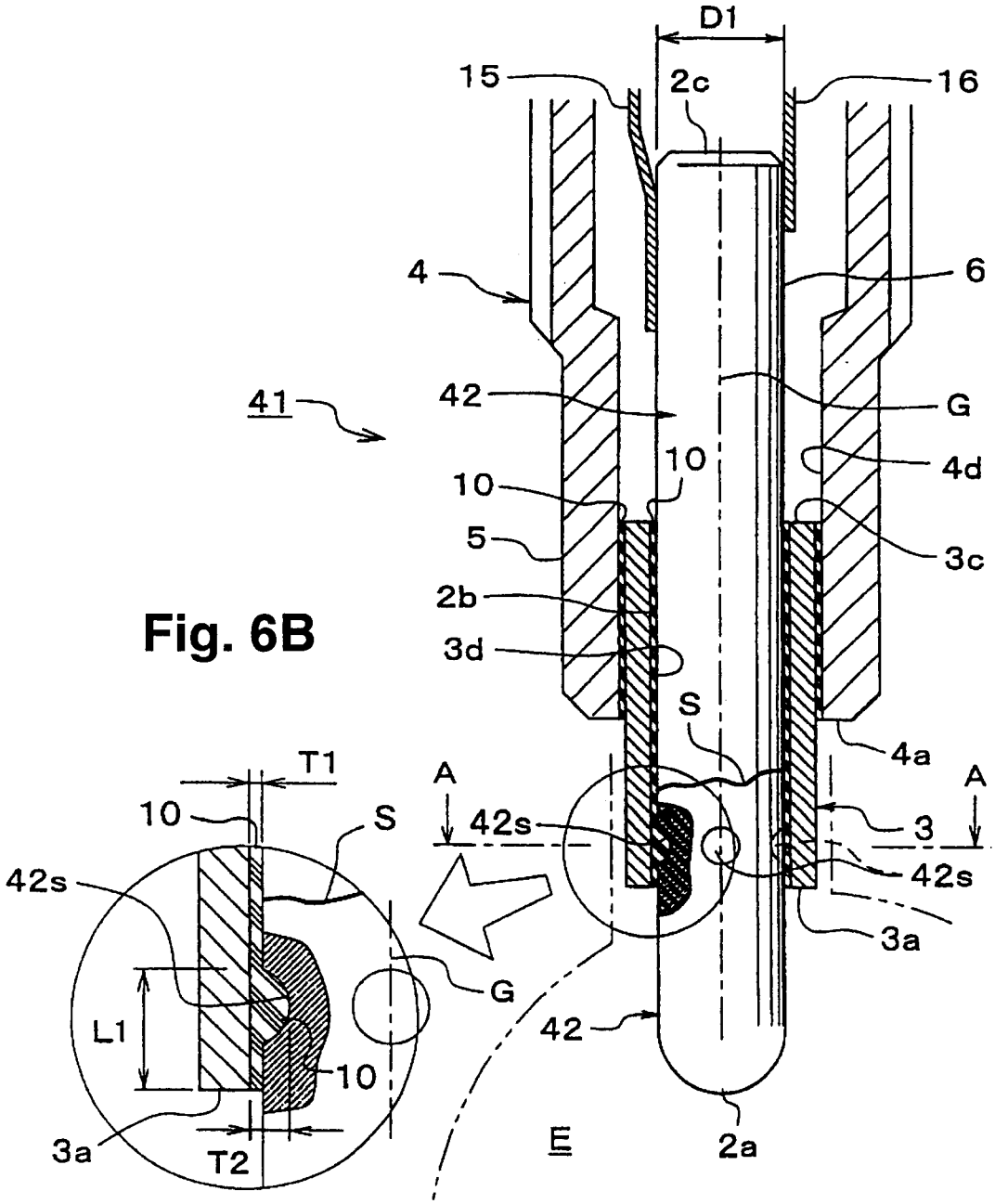
FIG. 6A is a sectional view of a specific portion of an embodiment of a ceramic heater device (or glow plug) according to the present invention.
FIG. 6B is an enlarged sectional view of a specific portion.
Figure 7:
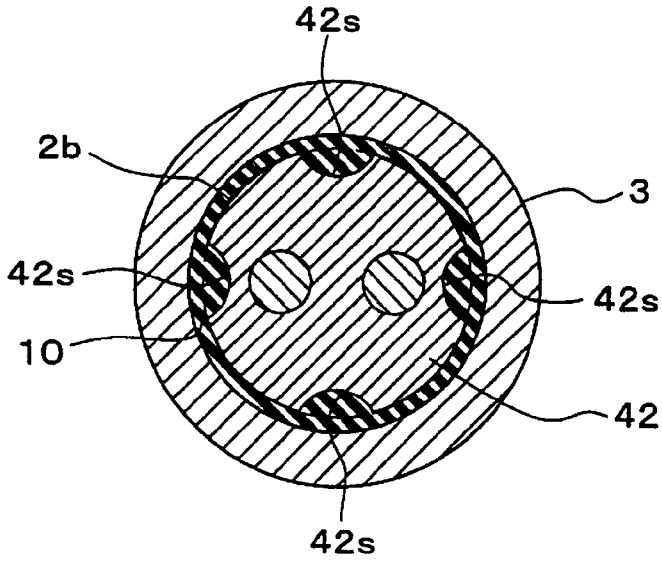
FIG. 7 is a sectional view along line A—A of FIG. 6.

Next, a further embodiment of the present invention will be described with reference to FIGS. 6 and 7. However, a glow plug 41 of the present embodiment is a modification of the foregoing embodiment so that description will be made only on different points by designating identical portions by identical reference numerals. In this embodiment, more specifically, the diametrically smaller portion 32*s* having the circumferential groove shape in the ceramic heater 32 of the foregoing embodiment is replaced by four hemispherical recesses 42*s*, for example, which are formed at an equal angular spacing on the axis G, as shown in FIGS. 6 and 7.

In the present embodiment, of the solder layer 10 fixing the outer circumference of a ceramic heater 42 and the inner circumference of the metallic cylinder member 3 through the solder material, the solder existing present in those recesses prevents slide-out of the ceramic heater.

Figures 8A, 8B:
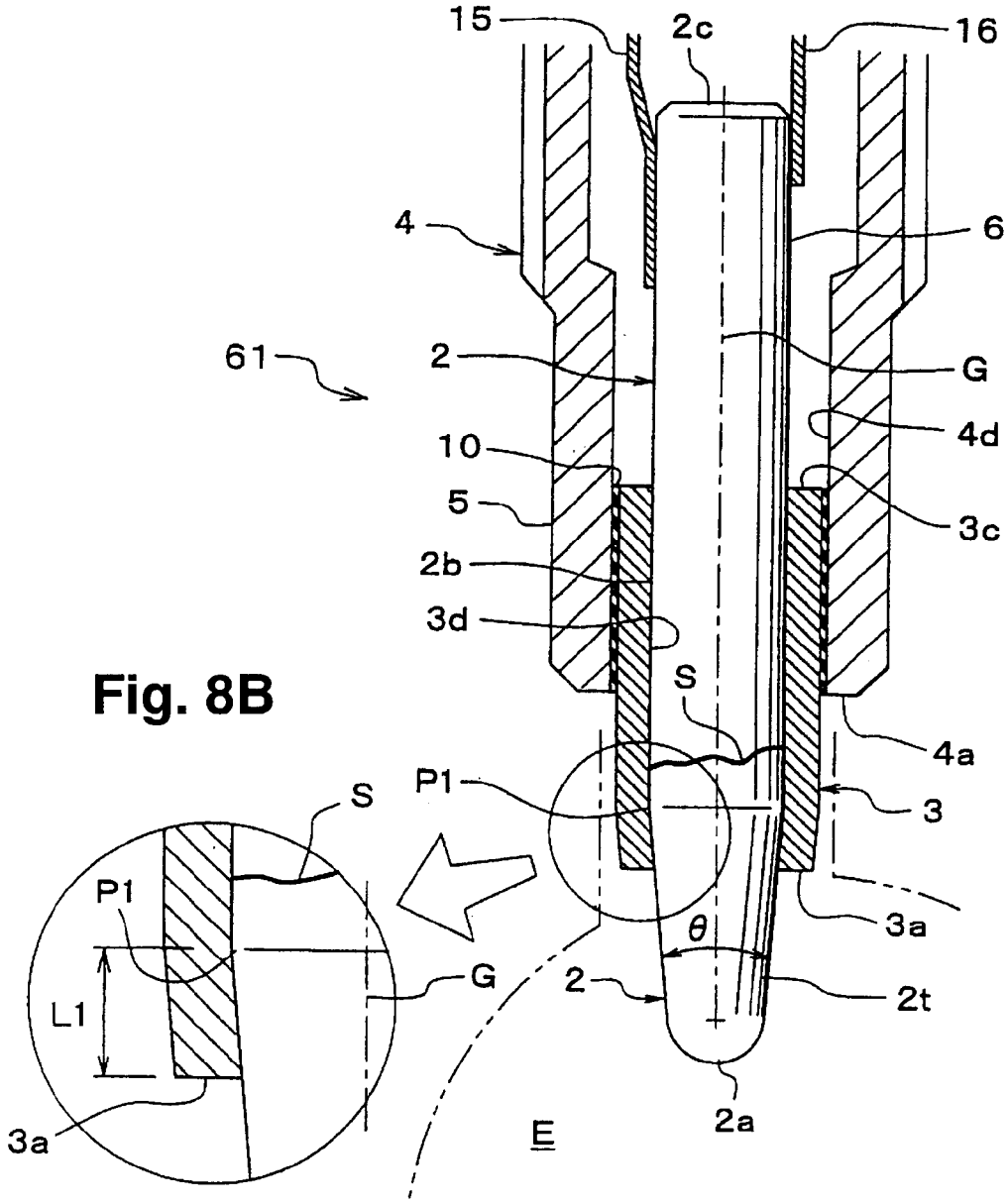
FIG. 8A is a sectional view of a specific portion of an embodiment of a ceramic heater device (or glow plug) according to the present invention.
FIG. 8B is an enlarged sectional view of a specific portion.

Any of the foregoing embodiments is given the structure in which the ceramic heater and the metallic cylinder member 3 are integrated by fitting the ceramic heater loosely in the metallic cylinder member 3 and by pouring the molten solder into the clearance to fix the cylinder member 3. The slide-out preventing action is effecting by using a portion of the fixing solder layer. For assembly, therefore, a step of pouring the molten solder is needed. With reference to FIGS. 8 and 9, a different embodiment of the present invention will be described, which needs no fixing by the solder material.

A glow plug 61 of the present embodiment is essentially different from that of the first embodiment in that it is constructed not by soldering the ceramic heater and the metallic cylinder member but by press-fitting the ceramic heater 2 in the metallic cylinder member 3. However, there is no fundamental difference in other points. Therefore, the description will be centered on the different points and properly omitted by designating common portions by identical reference numerals.

The present embodiment is constructed of: the convergent rod-shaped ceramic heater 2; the metallic cylinder member 3 arranging the ceramic heater 2 by press-fitting it therein; and the body 4 for holding the ceramic heater 2 through the metallic cylinder member 3 having the ceramic heater 2 integrated therewith. The ceramic heater 2 is integrated by protruding the portion close to its leading end 2*a* and press-fitting itself in the metallic cylinder member 3. This integrated metallic cylinder member 3 is fixed by fitting a portion close to its rear end 3*c* loosely in the diametrically reduced portion 5, in which the inner circumference 4*d* of the body 4 close to the leading end 4*a* is slightly diametrically reduced, and by pouring the silver solder 10 into that clearance.

The ceramic heater 2 constituting the glow plug 1 of the present embodiment is identical to that of FIG. 1. Moreover, this ceramic heater 2 is press-fitted in the straight cylinder member (having a length of 20 mm) 3 made of a metal (e.g., SUS430) and protrudes at a portion close to its leading end 2*a* by a predetermined length (i.e., 10 mm in the present embodiment). Moreover, the taper starting point P1 of the taper portion 2*t* is arranged with a size L1 on the rear side of the leading end 3*a* of the metallic cylinder member 3. In other words, the ceramic heater 2 is press-fitted from the side of the leading end 2*a*, but this press-fitting is stopped at a point where the leading end 3*a* of the metallic cylinder member 3 is positioned midway of the taper portion 2*t*.

As a result, in the portion of the metallic cylinder member 3 close to the leading end 3*a*, as shown in FIG. 8, the portion on the leading side of the taper starting point P1 of the taper portion 2*t* converges to conform to the taper portion 2*t*. When cut in a plane extending through the axis G, more specifically, the portion of the metallic cylinder member 3 close to its leading end 3*a* is diametrically smaller as it nears the leading end 3*a*, to thereby regulate the ceramic heater 2 toward the leading end.

Therefore, in the present embodiment, too, actions and effects similar to those of the foregoing individual embodiments can be obtained, when the ceramic heater 2 is cut along the line S of FIG. 8, for example, and mounted in the auxiliary combustion chamber E of the diesel engine and when this engine is run. In the present embodiment, more specifically, in accordance with running of the engine, relaxation occurs between the inner circumference of the metallic cylinder member 3 and the outer circumference of the ceramic heater 2. Even if the leading end 2*a* of the ceramic heater 2 attempts to slide out to the leading end side of the metallic cylinder member 3, this slide-out is prevented because the portion of the taper portion 2*t* close to the leading end 3*a* of the metallic cylinder member 3 has a convergent shape. As a result, the leading end side of the cut portion of the ceramic heater 2 can be prevented from dropping into the auxiliary combustion chamber E.

Figure 9A:
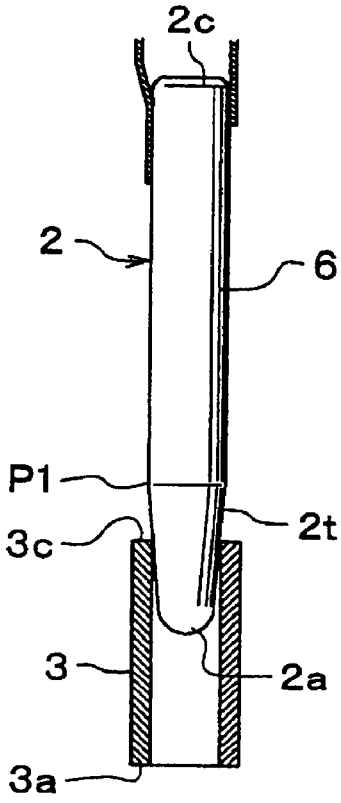
FIG. 9A presents a sectional view before press-fitted.
Figure 9B:
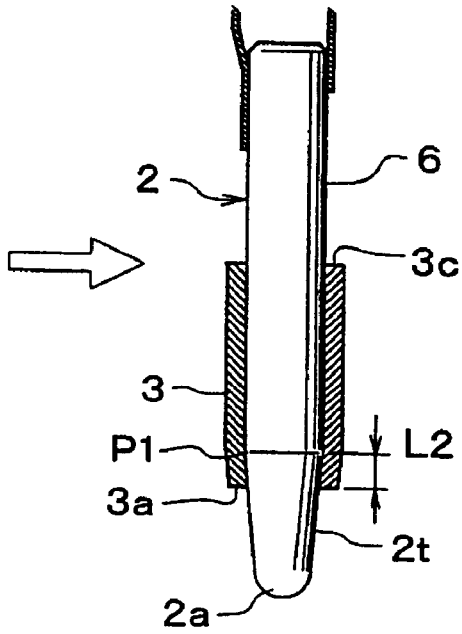
FIG. 9B presents a sectional view in the interference-fitted state after press-fitted.
Figure 10:
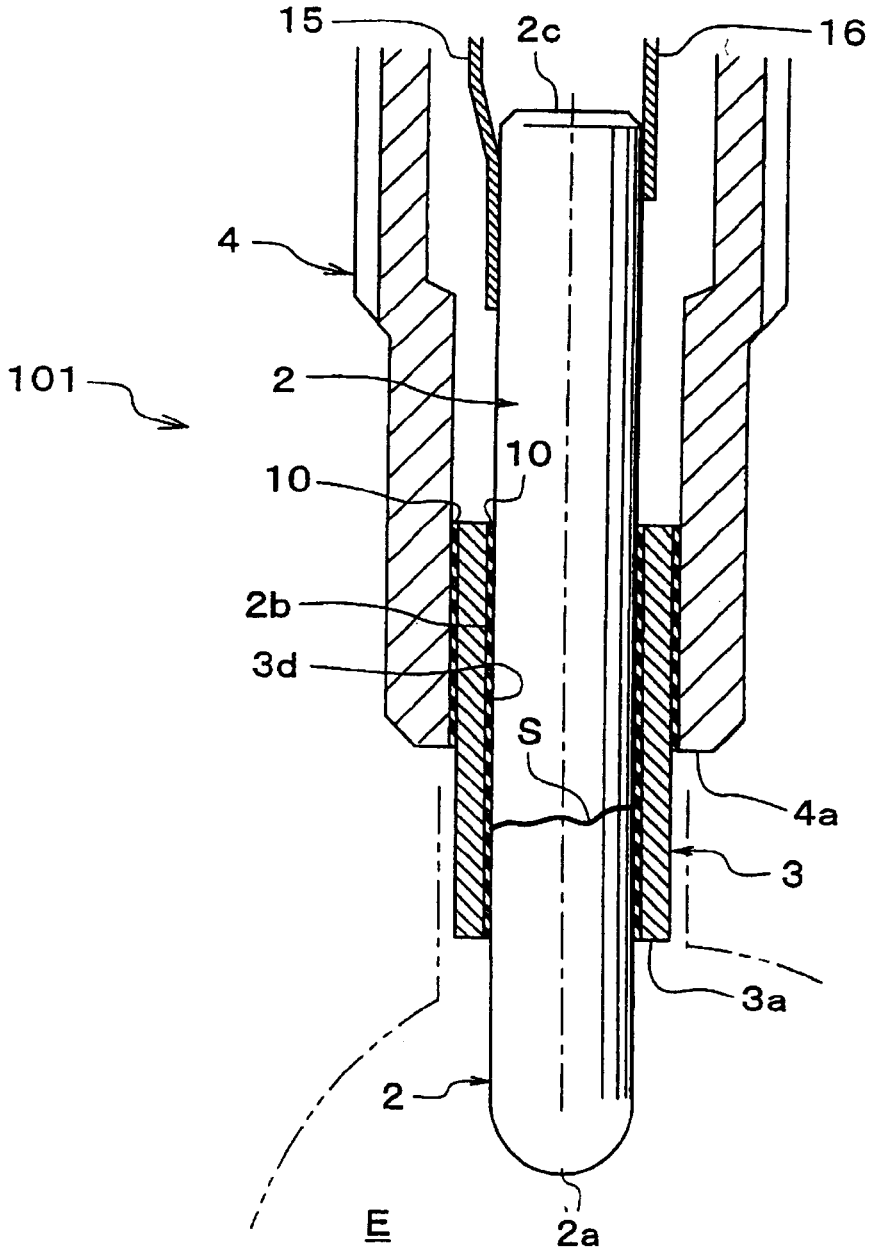
Fig. 10 PRIOR ART
FIG. 10 is a sectional view of a specific portion of the glow plug of the prior art.
Figure 11:
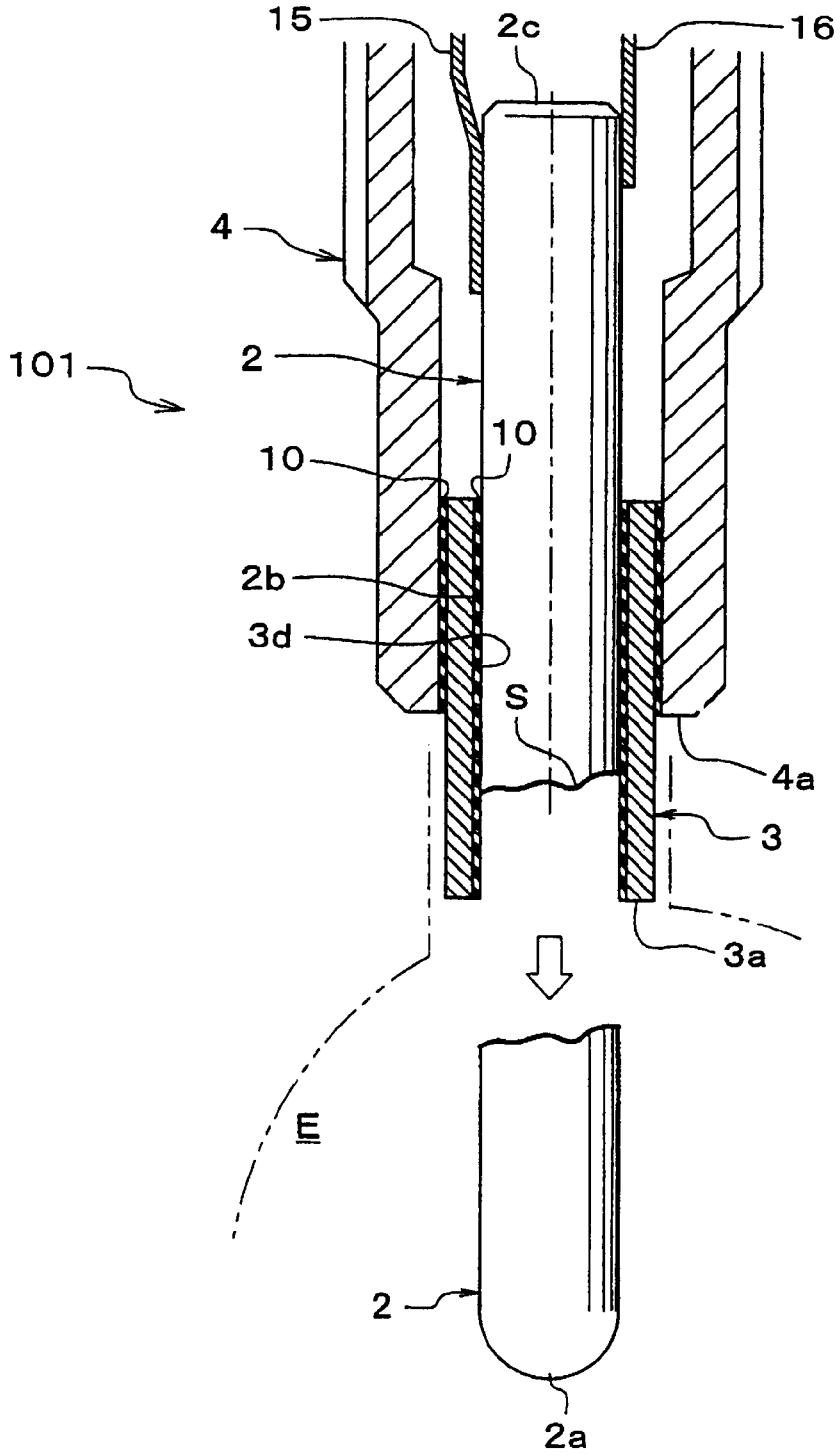
Fig. 11 PRIOR ART
FIG. 11 is an explanatory diagram of the state in which the heater leading end is cut and separated in FIG. 10.

Here, this press-fitting structure of the ceramic heater 2 in the metallic cylinder member 3 is acquired only by press-fitting the ceramic heater 2 from its leading end 2*a* into the cylinder member (having a length of 20 mm) 3 having a straight cylinder shape and made of a metal (e.g., SUS430), as shown in views FIG. 9A and FIG. 9B, to protrude the leading end 2*a* by a predetermined length (e.g., 10 mm in the present embodiment). Specifically, this press-fitting is performed so far that the leading end 3*a* of the metallic cylinder member 3 is positioned by a distance L2 on the leading end side from the taper starting point P1 of the taper portion 2*t*. Thus, the metallic cylinder member 3 is deformed and diametrically enlarged around the diametrically larger column portion 6 to an extent corresponding to the press-fit but not so diametrically enlarged on the leading end side from the taper starting point P1 of the taper portion 2*t*, so that it is formed relatively into the convergent shape. In the present embodiment, the cylinder member 3 thus employed has an internal diameter of 3.35 mm and an external diameter of 5 mm (and has a thickness of 0.825 mm).

In the present embodiment, too, the slide-out preventing action is higher at larger cone angle θ of the taper portion 2*t*, because the converging angle of the leading end of the metallic cylinder member is larger. At an excessively large cone angle θ, however, the press-fit cannot be smoothed. At the smaller cone angle θ, on the other hand, the press-fit becomes the smoother, but it becomes necessary to retain the larger length of the taper portion 2*t*. The cone angle θ of the case using such press-fitting structure is preferably set within a range of 10 minutes to 2 degrees, although depending on the press-fitting allowance necessary for retaining the gas-tightness, the distance L2 in the direction of the axis G from the taper starting point P1 of the taper portion 2*t* to the leading end face 3*a* of the metallic cylinder member 3, or the material of the metallic cylinder member.

Here, the press-fitting structure of the present embodiment is automatically enabled to integrate the ceramic heater with the metallic cylinder member and to prevent the ceramic heater from coming out by effecting the press-fit in a preset depth, as described hereinbefore. Moreover, the metallic cylinder member 3 may be a straight cylinder so that it can have a high manufacturing efficiency. In the structure of the present embodiment in which the ceramic heater 2 is fixed by press-fitting in the metallic cylinder member 3, still moreover, the step of applying glass to the outer circumference of the ceramic heater 2, the soldering step, and the step of plating the metallic cylinder member 3 can be eliminated to simplify the manufacturing process and to lower the manufacturing cost.

The foregoing individual embodiments have been exemplified in case of the ceramic heater device embodied as a glow plug, but the applied examples should not be limited thereto. The ceramic heater device can be applied to an igniting heater for a petroleum fan heater and also to various other heaters.

According to the ceramic heater device of the present invention, as apparent from the above description, even if the ceramic heater is cut within the metallic cylinder member and assembled in the engine and is then run, the cut portion can be prevented from dropping into the engine. This prevention is also realized even in case the ceramic heater is cut after being assembled in the engine. Even in case the ceramic heater is applied to the igniting heater of the petroleum fan heater, moreover, it is likewise effective to prevent the cut portion from separating and coming out.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

This application is based on Japanese Patent Application No. 2001-66049 filed Mar. 9, 2001, the disclosure of which is incorporated herein by reference in its entirety.

What is claimed is:

1. A ceramic heater device having a structure in which an axial ceramic heater is arranged in a metallic cylinder member so that its leading end protrudes from the leading end of said metallic cylinder member, wherein:

a convergent taper portion is formed at the leading end of said ceramic heater;

the leading end of said metallic cylinder member is disposed on the leading end side of the taper starting point of said taper portion;

said metallic cylinder member and said ceramic heater are fixed to each other with a solder layer interposed between their inner circumference and outer circumference respectively; and at least a portion of said solder layer is also disposed on the leading end side of the taper starting point of said taper portion.

* * * * *